US012303954B2

(12) United States Patent
Sun et al.

(10) Patent No.: US 12,303,954 B2
(45) Date of Patent: May 20, 2025

(54) HOMOGENIZATION CONTROL METHOD FOR TRANSVERSE TEMPERATURE DURING LAMINAR COOLING OF HOT-ROLLED STRIP

(71) Applicant: Northeastern University, Shenyang (CN)

(72) Inventors: Jie Sun, Shenyang (CN); Shuo Liu, Shenyang (CN); Hao Wu, Shenyang (CN); Wen Peng, Shenyang (CN); Dianhua Zhang, Shenyang (CN)

(73) Assignee: Northeastern University, Shenyang (CN)

( * ) Notice: Subject to any disclaimer, the term of this patent is extended or adjusted under 35 U.S.C. 154(b) by 325 days.

(21) Appl. No.: 18/169,987

(22) Filed: Feb. 16, 2023

(65) Prior Publication Data

US 2024/0024937 A1 Jan. 25, 2024

(30) Foreign Application Priority Data

Jul. 21, 2022 (CN) ..... 202210872550.7

(51) Int. Cl.
*B21B 37/74* (2006.01)
*B21B 1/22* (2006.01)

(52) U.S. Cl.
CPC ..... *B21B 37/74* (2013.01); *B21B 1/22* (2013.01); *B21B 2001/225* (2013.01)

(58) Field of Classification Search
CPC ..... B21B 37/74; B21B 2001/225; B21B 37/76; B21B 45/0218
See application file for complete search history.

(56) References Cited

FOREIGN PATENT DOCUMENTS

CN 105598185 A * 5/2016
CN 112036056 A * 12/2020 ..... B21B 37/74
RU 2655398 C2 * 5/2018

OTHER PUBLICATIONS

Translation of CN-112036056.*
Translation of RU-2655398.*
Translation of CN-105598185.*

* cited by examiner

*Primary Examiner* — Bobby Yeonjin Kim

(57) ABSTRACT

Some embodiments of the disclosure provide a method for homogeneously controlling a transverse temperature during laminar cooling of a hot-rolled strip. In an embodiment, a mathematical model of middle convexity cooling in a water volume is established by designing different types of middle convexity water cooling heat transfer coefficient curves. Process procedures and equipment parameters of the hot-rolled strip during the laminar cooling are considered to restore the actual situation on site. Through finite element calculation, an optimal middle convexity water cooling heat transfer coefficient curve is obtained. Process parameters corresponding to middle convexity water volume distribution during the laminar cooling (a water flow density) are further obtained to guide a water volume control process.

10 Claims, 16 Drawing Sheets

HOMOGENIZATION CONTROL METHOD FOR TRANSVERSE TEMPERATURE DURING LAMINAR COOLING OF HOT-ROLLED STRIP

CROSS REFERENCE TO RELATED APPLICATION

This patent application claims the benefit and priority of Chinese Patent Application No. 202210872550.7, filed with the China National Intellectual Property Administration on Jul. 21, 2022, the disclosure of which is incorporated by reference herein in its entirety as part of the present application.

FIELD OF THE DISCLOSURE

The disclosure relates generally to the field of automatic control of steel rolling. More specifically, the disclosure relates to methods for homogeneously controlling a transverse temperature during laminar cooling of a hot-rolled strip.

BACKGROUND

Laminar cooling after rolling is an important process to adjust the microstructure properties and optimize the shape of hot-rolled strip. Although having been rolled flat after passing through the finishing mill, the hot-rolled strip has flatness defects in the width direction during the laminar cooling. This is mainly due to the non-uniform distribution of the transverse temperature during the cooling, resulting in residual stress in the strip, which causes the flatness defects such as buckling. At present, various transverse temperature homogenization cooling technology are developed with the essence of changing the transverse water cooling heat transfer coefficient curve by regulating the water volume.

The non-uniform distribution of the transverse temperature of strip during the laminar cooling is caused by three factors. First, the initial transverse temperature distribution of the strip after rolling into laminar cooling is non-uniform, and there is edge supercooling. Second, during the laminar cooling, the cooling water of the upper header tends to accumulate on the upper surface of the strip and flows from the middle area to the edge area of the strip, which increases the degree of supercooling in the edge area of the strip. Finally, during the laminar cooling, although the distribution of water flow in the transverse header is uniform, the non-uniform width temperature phenomenon still exists after the cooling. This is due to the non-uniform distribution of transverse temperature in the strip when it is discharged from the finishing mill. Most of the existing researches are aimed at the devices and equipment for homogenization cooling of transverse temperature during the laminar cooling, such as the design of nozzle structure parameters, edge masking amount, and cooling header valves. Such design basically optimizes and analyzes the cooling intensity. However, there are few researches on the cooling distribution, namely the transverse water cooling heat transfer coefficient curve itself. Moreover, in the application of strip water convexity distribution, most equipment parameters are debugged and set based on empirical formulas and data. In addition, the cooling mathematical model and water cooling heat transfer coefficient curve have not been thoroughly studied.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

In some embodiments, the disclosure provides a method for homogeneously controlling a transverse temperature during laminar cooling of a hot-rolled strip including the following steps.

(I) Dividing a transverse area of an upper surface of the strip, according to distribution of the transverse temperature of the strip, into a middle area, a left edge area, and a right edge area. The middle area has a uniform transverse temperature and the left edge area and the right edge are symmetrical, have the same width, and have transverse temperature drop in the width direction.

(II) Determining model parameters by collecting geometric parameters and initial temperature parameters of the strip. The geometric parameters include a strip thickness t, a strip width b, a strip length e, a width of an edge temperature drop area of the strip c, and a transverse center coordinate, a left edge coordinate, and a right edge coordinate of the strip. The initial temperature parameters include a temperature $T_0$ of the middle area of the strip and a temperature $T_0'$ of an edge of the strip.

(III) Establishing a finite element model, according to the geometric parameters collected in step (II), by the following steps: establishing a geometric model of the strip, assigning material thermophysical parameters and the initial temperature parameters to the geometric model, and performing element discretization by grid division of the model.

(IV) Setting third-type boundary conditions for the finite element model established in step (III). This step includes setting a heat transfer coefficient of a lower surface of the strip and setting at least two parameters selected from the group consisting of a heat transfer coefficient in the middle area of the strip $h_c$, a heat transfer coefficient at the edge of the strip $h_w$, and a convexity ratio m.

(V) Obtaining an analytical solution T(x, t) of a transverse temperature field of the strip through a heat conduction partial differential equation according to the geometric parameters, the initial temperature parameters, and the third-type boundary conditions.

(VI) Designing different types of middle convexity water cooling heat transfer coefficient curves H(x). In a water cooling process of laminar cooling of the hot-rolled strip, to achieve a transverse homogenizing cooling effect of the strip, it's necessary to set different water cooling heat transfer coefficient curves for the middle area and the edge temperature drop areas of the strip according to an edge supercooling condition of the strip before the laminar cooling. In such process, the heat transfer coefficients in the middle area of the strip are basically the same, but the heat transfer coefficient in the edge area of the strip becomes lower as it gets closer to the edge. As a result, an overall transverse water cooling heat transfer coefficient curve of the strip presents approximate saddle shaped distribution and is therefore called the middle convexity water cooling heat transfer coefficient curve, expressed as H(x).

(VII) Calculating a transverse water flow density distribution of the cooling water in a laminar cooling area corresponding to the different types of middle convexity water cooling heat transfer coefficient curves.

(VIII) Selecting an optimal middle convexity water cooling heat transfer coefficient curve to determine optimal transverse water flow density distribution of the cooling water in the laminar cooling area and to determine optimal middle convexity water volume distribution.

Optionally, the central axis in the width direction of the strip is taken as the center coordinate x=0 and the left edge coordinate and the right edge coordinate are $x=\pm b/2=\pm\delta$.

Optionally, the middle convexity water cooling heat transfer coefficient curve H(x) is:

$$H(x)=\begin{cases} h(x), & x\in[\delta-c,\delta] \\ h_c, & x\in[c-\delta,\delta-c] \\ h(-x), & x\in[-\delta,c-\delta] \end{cases}. \tag{1}$$

Here, $h_c$ is the water cooling heat transfer coefficient curve of the middle area of the strip, h(x) is the water cooling heat transfer coefficient curve of the edge temperature drop area on one side of the strip, and h(−x) is the water cooling heat transfer coefficient curve of the edge temperature drop area on another side of the strip.

Optionally, the water cooling heat transfer coefficient curve of the edge temperature drop area of the strip includes at least one item selected from the group consisting of primary functions, quadratic functions, sine cosine functions, logarithmic functions, and higher power functions.

Optionally, the water cooling heat transfer coefficient curve h(x) of the edge temperature drop area of the strip includes at least one item selected from the following group:

$$h_1(x)=\frac{(m-1)h_c}{mc}(-x+\delta)+\frac{h_c}{m}, \tag{2}$$

$$h_2(x)=\frac{(m-1)h_c}{mc^2}(-x+\delta)^2+\frac{h_c}{m}, \tag{3}$$

$$h_3(x)=\frac{(1-m)h_c}{mc^2}(-x+\delta)^2+\frac{2(m-1)h_c}{mc}(-x+\delta)+\frac{h_c}{m}, \tag{4}$$

$$h_4(x)=\frac{(m-1)h_c}{mc^3}(-x+\delta)+\frac{h_c}{m}, \tag{5}$$

$$h_5(x)=\frac{(m-1)h_c}{m}\sin\left[\frac{\pi}{2c}(-x+\delta)\right]+\frac{h_c}{m}, \tag{6}$$

$$h_c(x)=\frac{(m-1)h_c}{mln(c+1)}\ln[(-x+\delta)+1]+\frac{h_c}{m}. \tag{7}$$

Optionally, the middle convexity water cooling heat transfer coefficient curve H(x) is:

$$H(x)=\begin{cases} h_i(x), & x\in[\delta-c,\delta],\ i\in[1,6] \\ h_c, & x\in[c-\delta,\delta-c] \\ h_i(-x), & x\in[-\delta,c-\delta],\ i\in[1,6] \end{cases}. \tag{8}$$

Optionally, a method for calculating the middle convexity water volume distribution corresponding to the different types of middle convexity water cooling heat transfer coefficient curves includes substituting the analytical solution T(x, t) of the transverse temperature field of the strip and the different types of middle convexity water cooling heat transfer coefficient curves into a water volume calculation formula to obtain the transverse water flow density distribution of the cooling water in the laminar cooling area corresponding to each type of middle convexity water cooling heat transfer coefficient curve, and to further obtain approximate saddle shaped water volume distribution in the width direction of the strip corresponding to each type of middle convexity water cooling heat transfer coefficient curve Optionally, a method for selecting the optimal middle convexity water cooling heat transfer coefficient curve from the different types of middle convexity water cooling heat transfer coefficient curves includes following steps.

Calculating an actual temperature field of the strip according to a current laminar cooling process based on the established finite element model.

Calculating temperature fields of the different types of middle convexity water cooling heat transfer coefficient curves for the established finite element model.

Comparing the actual temperature field of the strip with the temperature fields of the different types of middle convexity water cooling heat transfer coefficient curves.

Analyzing a temperature difference between the middle area and the edge temperature drop area of the strip after laminar cooling for each temperature field.

Selecting a middle convexity water cooling heat transfer coefficient curve corresponding to a minimum temperature difference as an optimal middle convexity water cooling heat transfer coefficient curve.

BRIEF DESCRIPTION OF THE DRAWINGS

Illustrative embodiments of the present disclosure are described in detail below with reference to the attached drawing figures.

DETAILED DESCRIPTION

Figure 1:
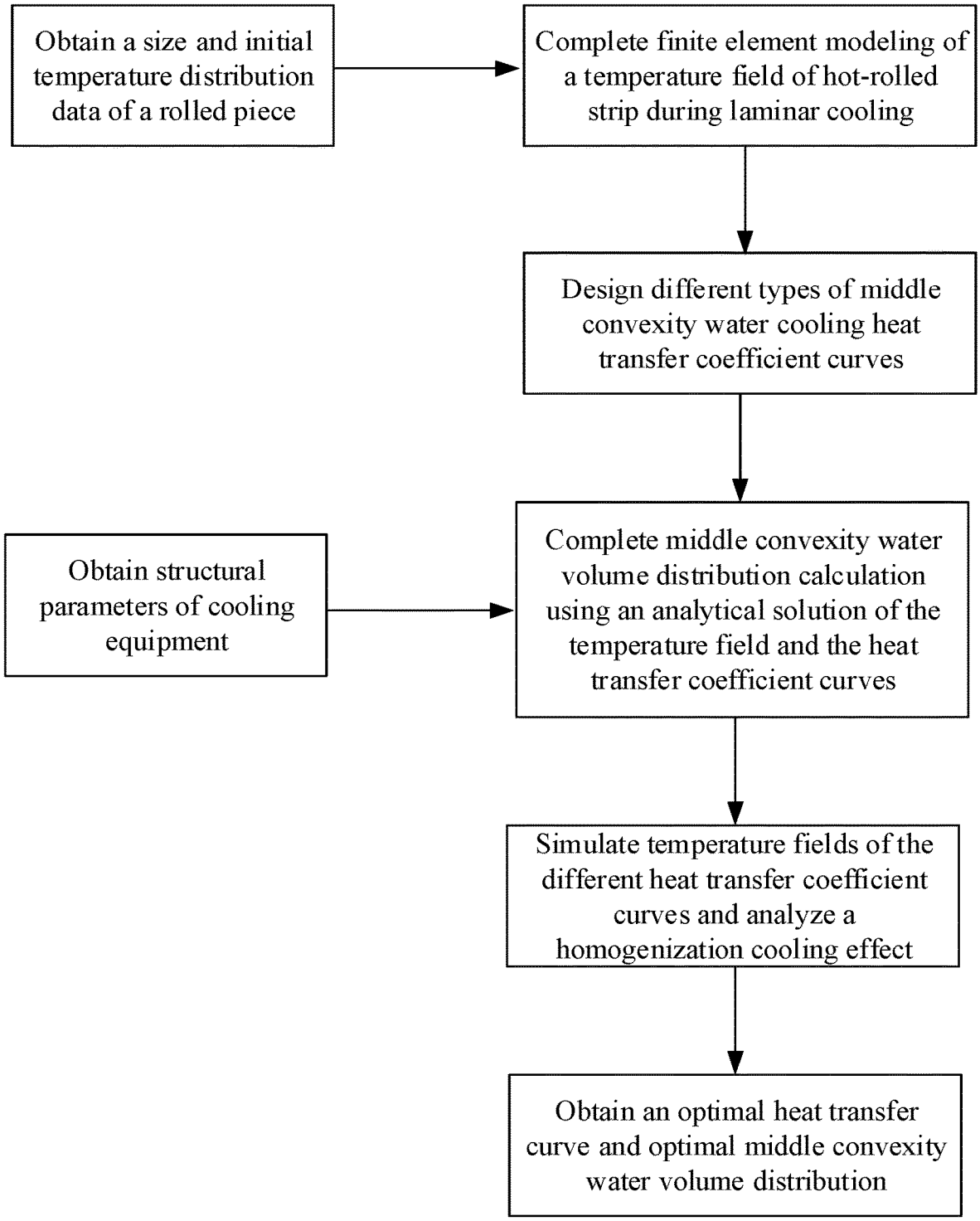
FIG. 1 is a schematic flowchart of a method for homogeneously controlling a transverse temperature during laminar cooling of hot-rolled strip according to an embodiment of the disclosure.

The following describes some non-limiting exemplary embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

To facilitate the understanding of the present disclosure, the present disclosure will be described more completely below with reference to the related accompanying drawings. The preferred implementations of the present disclosure are shown in the drawings. However, the present disclosure may be embodied in various forms without being limited to the implementations described herein. On the contrary, these implementations are provided to make the disclosure of the present disclosure more thorough and comprehensive.

Taking a laminar cooling process of Q235B hot-rolled strip with a thickness of 3 mm, a length of 6,000 mm and a width of 1,200 mm as an embodiment, a method for homogeneously controlling a transverse temperature during laminar cooling of hot-rolled strip of the present disclosure is described in detail based on the calculation of the ANSYS software. As shown in FIG. 1, the method for homogeneously controlling a transverse temperature during laminar cooling of hot-rolled strip includes the following steps.

Step 1: a transverse area of an upper surface of the rolled strip is divided: according to distribution of the transverse temperature of the rolled strip, the upper surface of the rolled strip is divided into a middle area of the strip with uniform transverse temperature and symmetrical edge temperature drop areas on left and right sides of the strip with a same width and gradually dropped transverse temperature in a width direction.

The temperature of the middle area of the strip is uniform. The temperature of the edge temperature drop area of the strip gradually drops from the dividing line with the middle area of the strip to the edge of the strip. The temperature at the dividing line with the middle area of the strip is the highest, and the temperature at the edge of the strip is the lowest.

Step 2: model parameters are determined: geometric parameters and initial temperature parameters of the rolled strip are collected.

Figure 2:
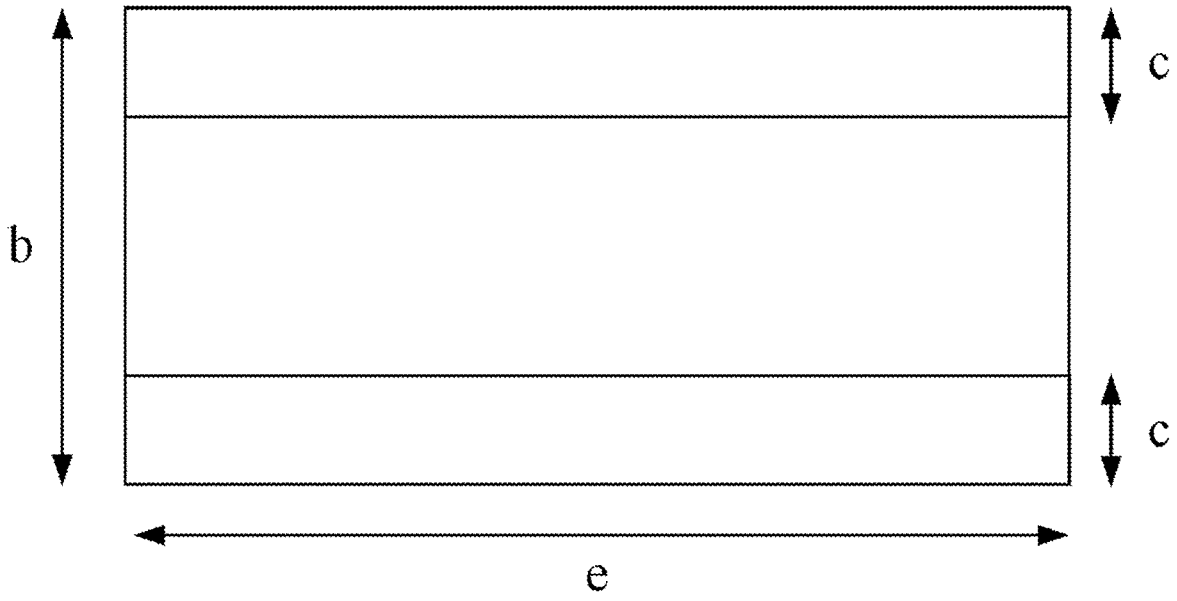
FIG. 2 shows a schematic diagram of geometric dimensions of the hot-rolled strip according to an embodiment of the disclosure.
Figure 3:
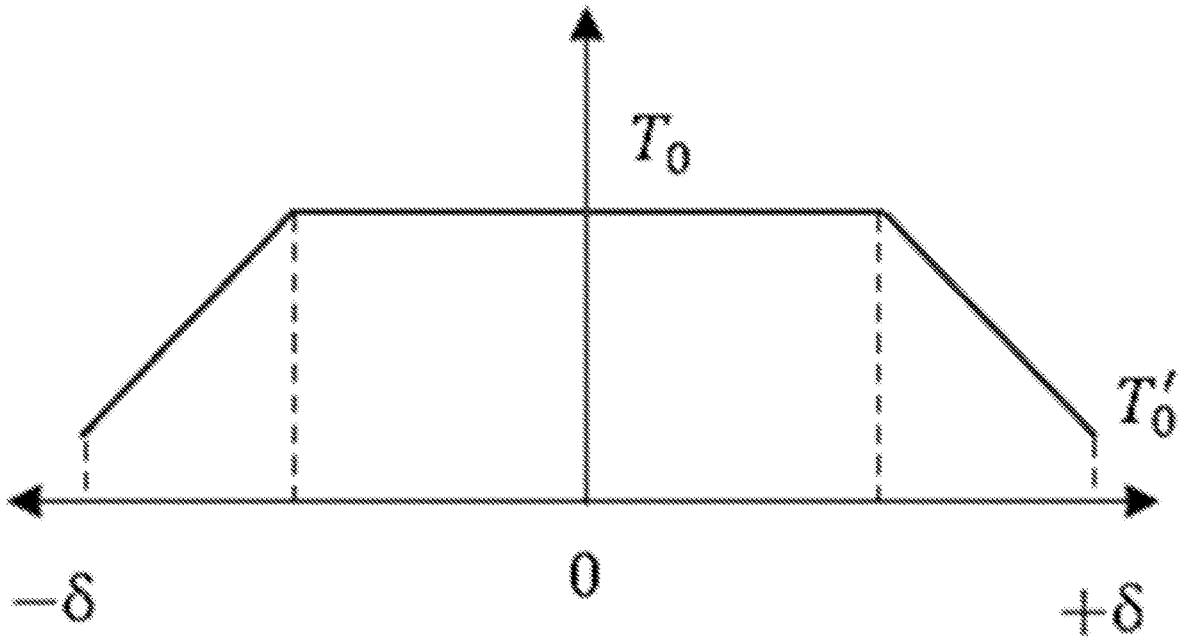
FIG. 3 shows a schematic diagram of a transverse initial temperature of the strip according to an embodiment of the disclosure.

The geometric parameters include a thickness t, a width b, a length e, and a width of the edge temperature drop area c of the strip, as shown in FIG. 2. The geometric parameters further include a transverse center coordinate and left and right edge coordinates of the strip. In the present disclosure, a central axis in the width direction of the strip is taken as the center coordinate x=0, and the left and right edge coordinates of the strip are $x=\pm b/2=\pm\delta$, as shown in FIG. 3.

The initial temperature parameters include a temperature $T_0$ of the middle area of the rolled strip and a temperature $T_0'$ of an edge of the strip. When the finished rolled strip is about to enter the laminar cooling stage, the transverse temperature distribution of the strip is not uniform. The temperature in the middle area of the strip is $T_0$, the edge temperature of the strip is $T_0'$, and the edge temperature drop area of the strip drops from the temperature $T_0$ at the dividing line with the middle area of the strip to the edge temperature $T_0'$, as shown in FIG. 3.

Figure 4:
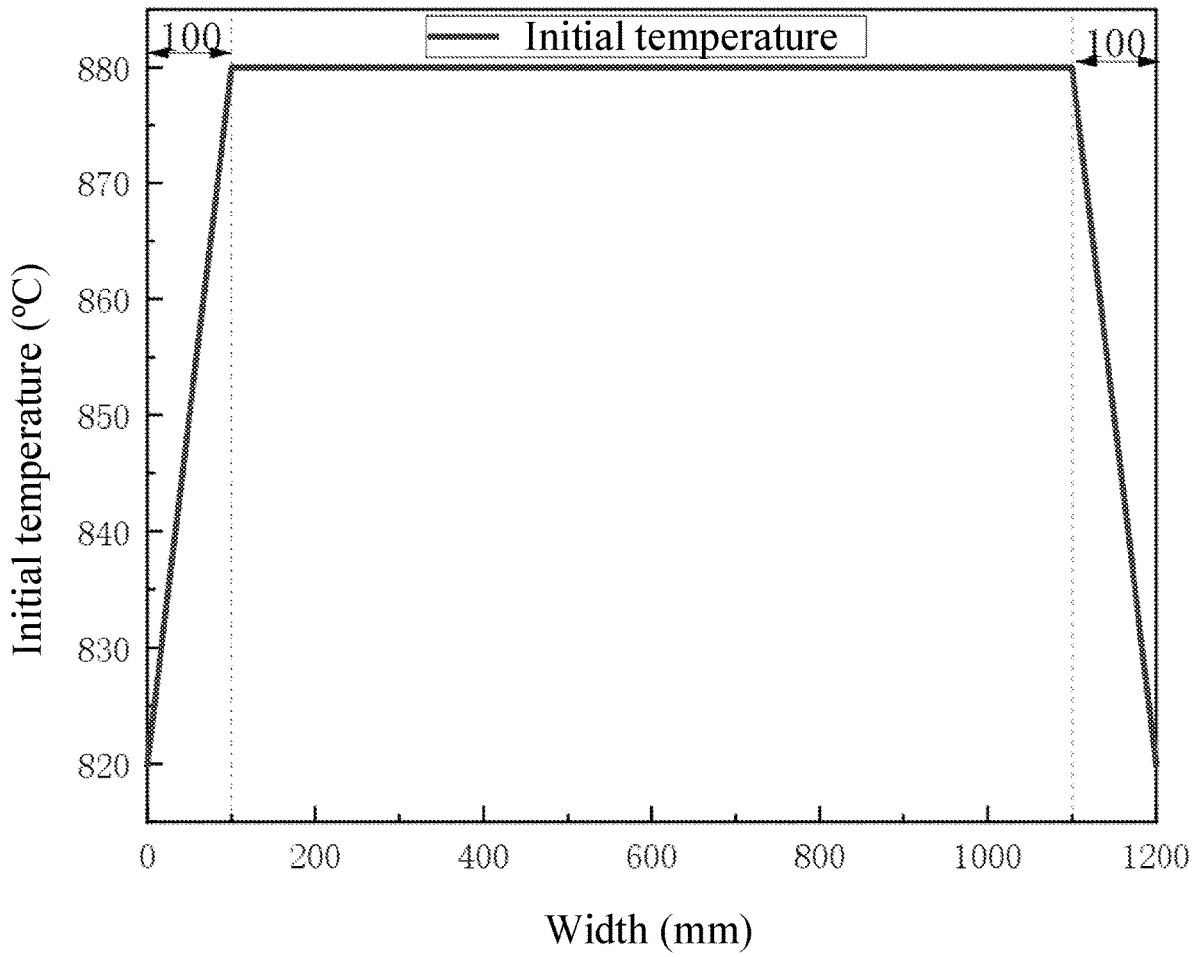
FIG. 4 shows a schematic diagram of initial temperature distribution of Q235B hot-rolled strip after rolling according to an embodiment of the disclosure.

In the present embodiment, Q235B hot-rolled strip after rolling has a length of 6,000 mm, a thickness of 3 mm, and a width of 1,200 mm. The edge temperature drop areas on the left and right sides of the middle area of the strip have a width of 100 mm. The strip has a transverse center coordinate of x=0, and the strip has left and right edge coordinates of x=±600. The initial temperature of the middle area of the strip on the upper surface of the strip is 880° C., and the temperature of the edge temperature drop area on the upper surface gradually drops to 820° C. at the edge. As shown in FIG. 4, the temperature of the edge temperature drop area drops approximately linearly.

Step 3: a finite element model is established: according to the geometric parameters collected in step 2, a geometric model of the hot-rolled strip after rolling is established through ANSYS software, and the initial temperature parameters and material thermophysical parameters collected in step 2 are assigned to the established model. Grid division is performed for element discretization of the model.

Figure 5:
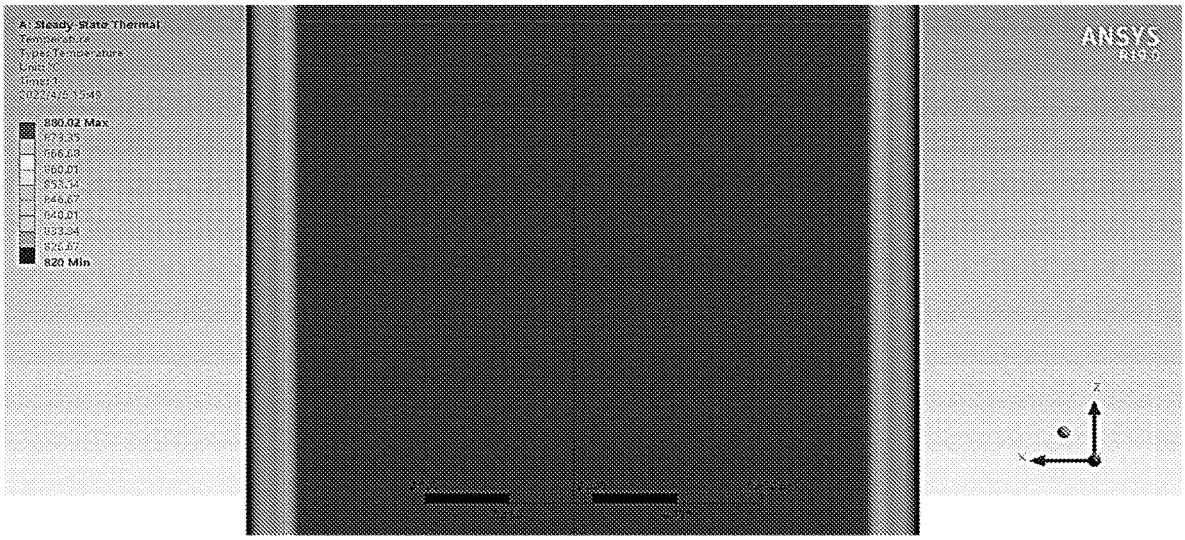
FIG. 5 shows a finite element model diagram of an initial temperature field of the Q235B hot-rolled strip after rolling according to an embodiment of the disclosure.
Figure 6A:
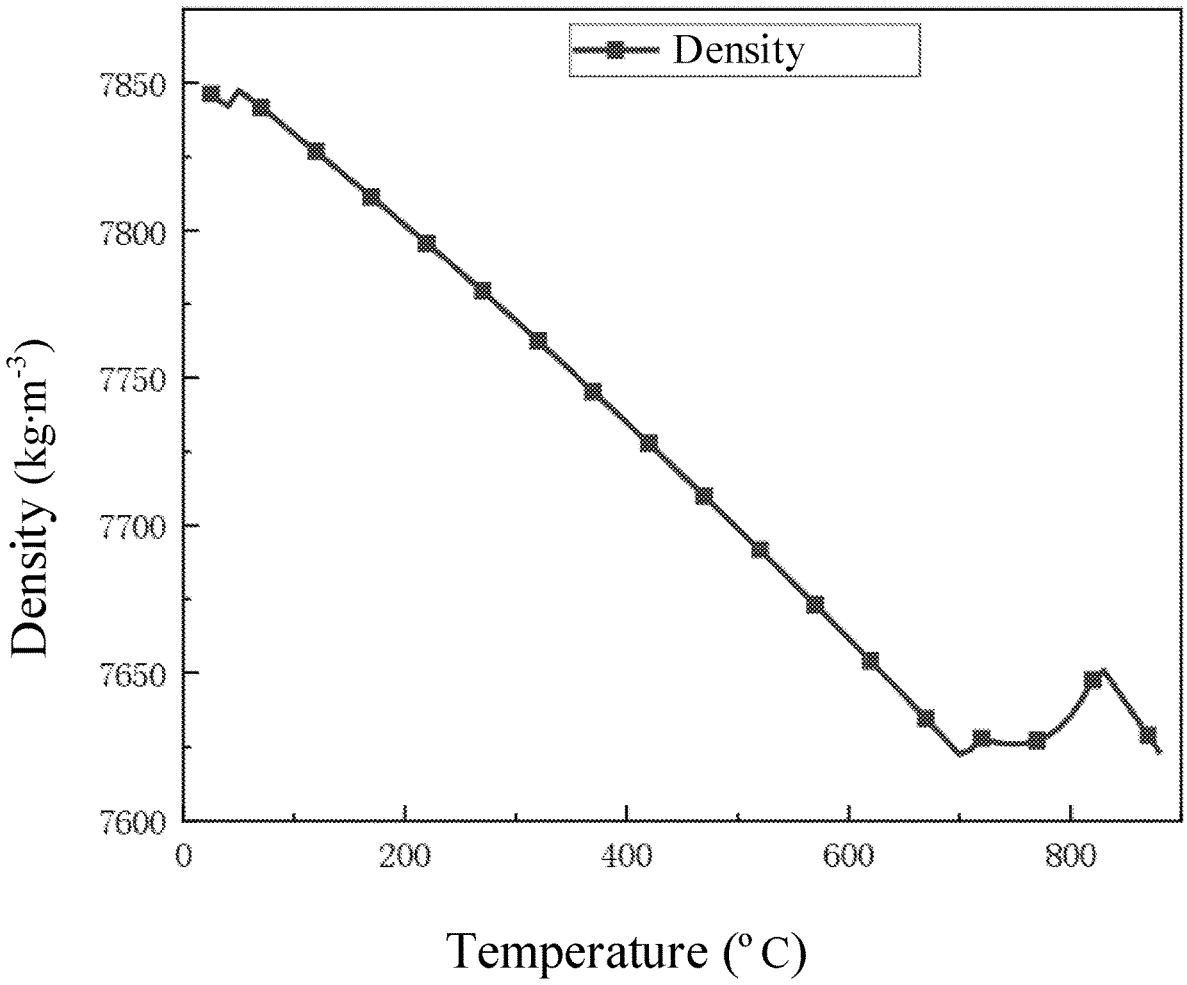
FIG. 6A shows a density diagram of the Q235B strip according to an embodiment of the disclosure.
Figure 6B:
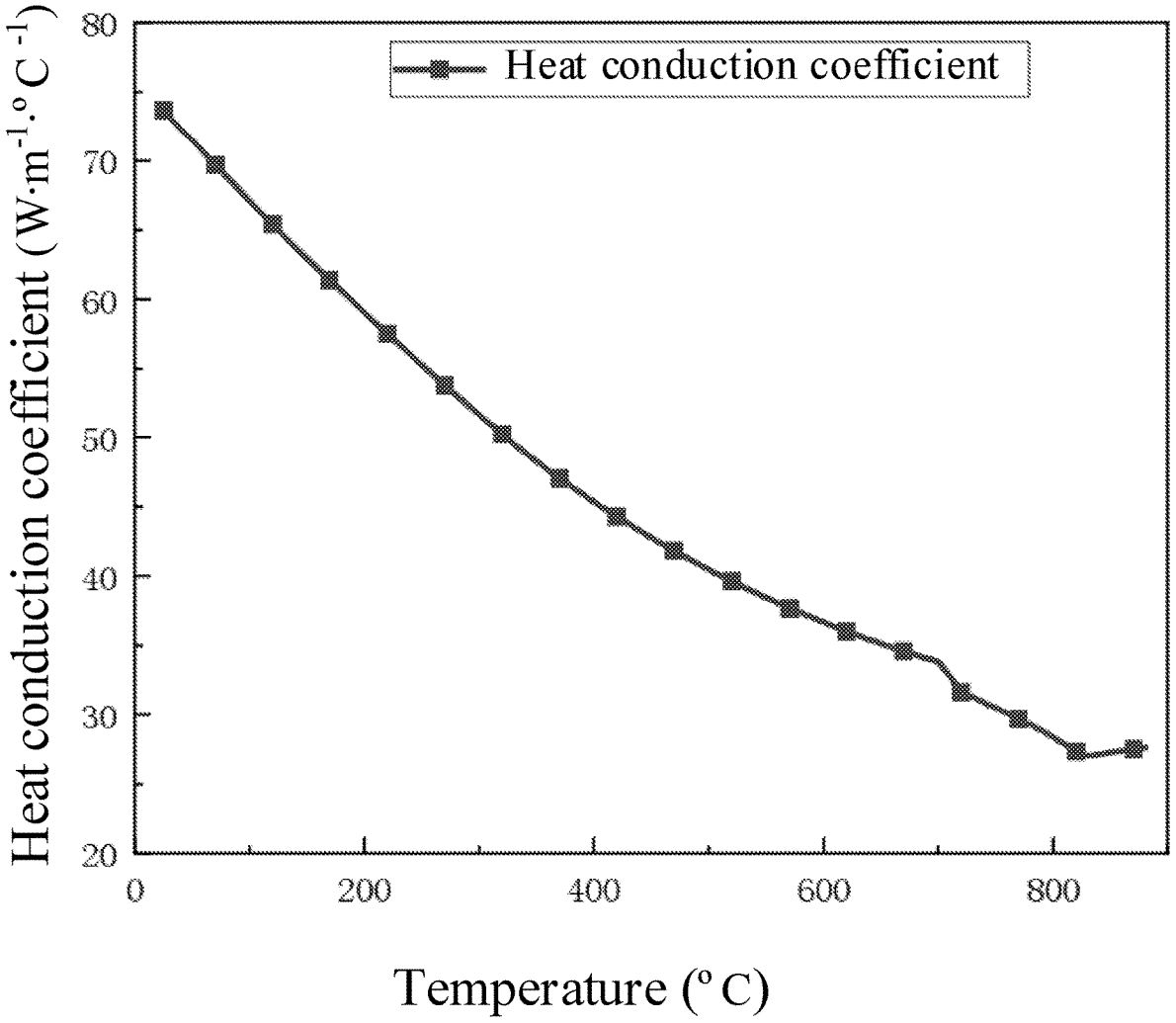
FIG. 6B shows a heat conduction coefficient diagram of the Q235B strip according to an embodiment of the disclosure.
Figure 6C:
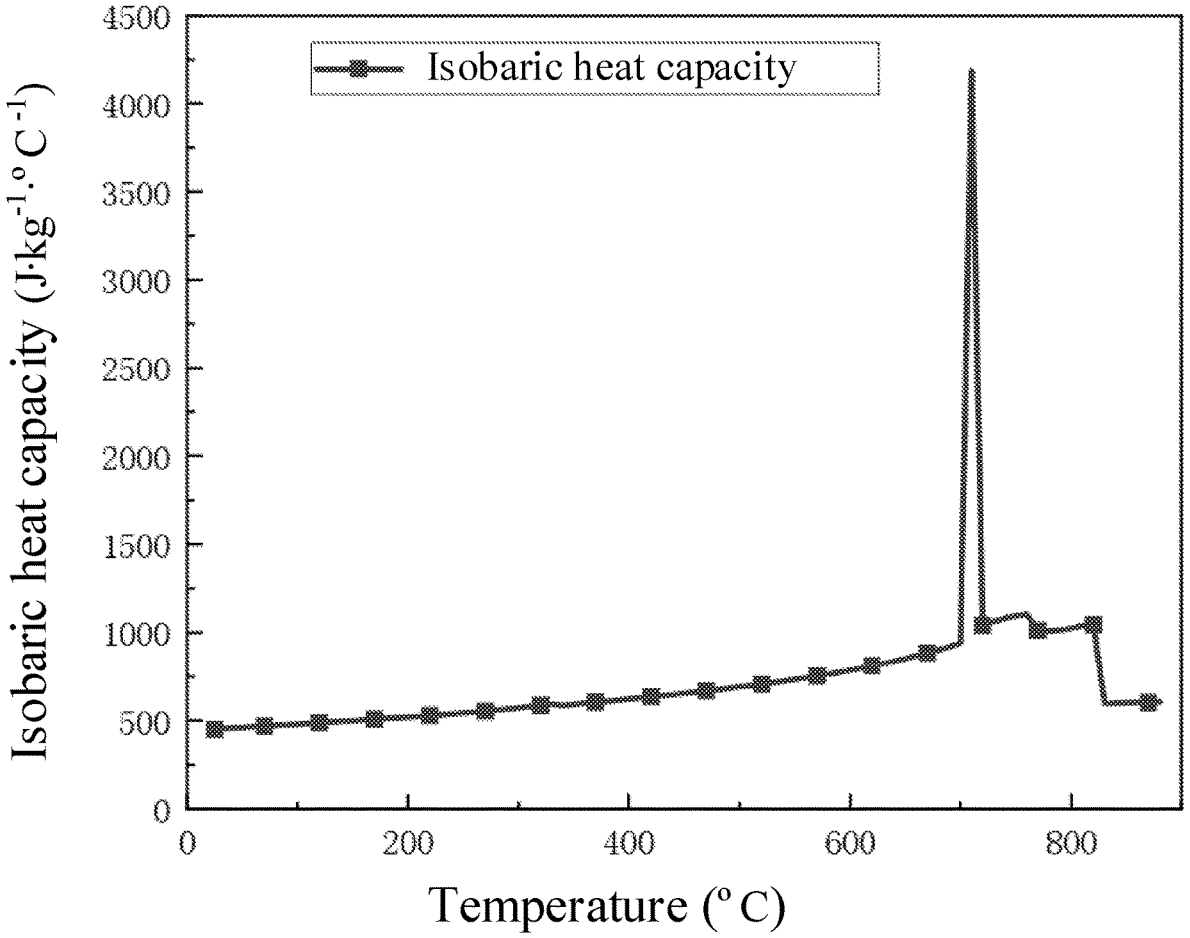
FIG. 6C shows an isobaric heat capacity diagram of the Q235B strip according to an embodiment of the disclosure.
Figure 6D:
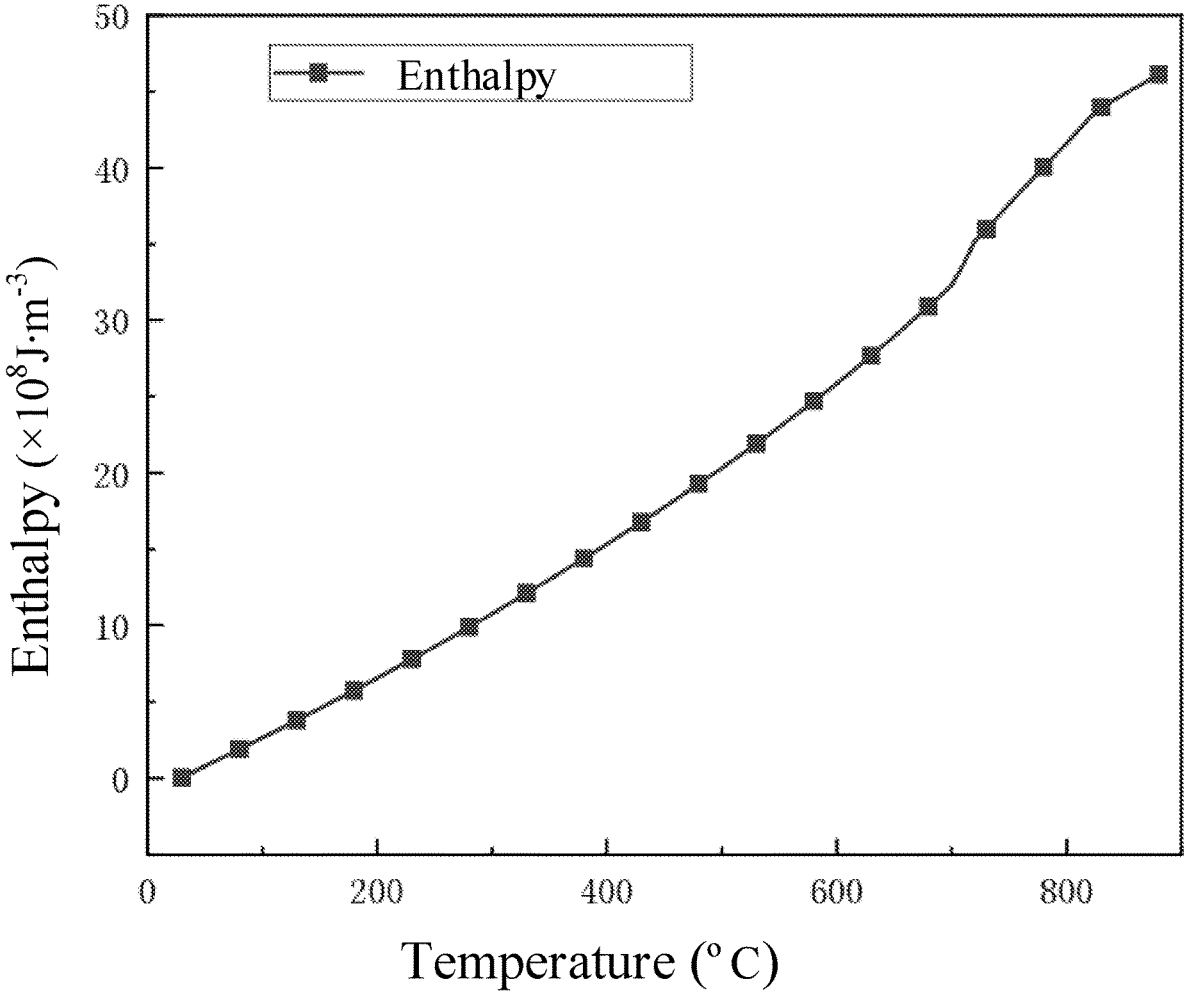
FIG. 6D shows an enthalpy diagram of the Q235B strip according to an embodiment of the disclosure.

In the present embodiment, a finite element model diagram of an initial temperature field of the Q235B hot-rolled strip after rolling obtained after a geometric model of the Q235B hot-rolled strip after rolling is established through ANSYS software according to the geometric parameters collected in step 2, and the initial temperature parameters and material thermophysical parameters collected in step 2 are assigned to the established model is shown in FIG. 5. In the present embodiment, the thermophysical parameters include a density diagram of the Q235B strip shown in FIG. 6A, a heat conduction coefficient diagram of the Q235B strip shown in FIG. 6B, an isobaric heat capacity diagram of the Q235B strip shown in FIG. 6C and an enthalpy diagram of the Q235B strip shown in FIG. 6D.

Figure 7:
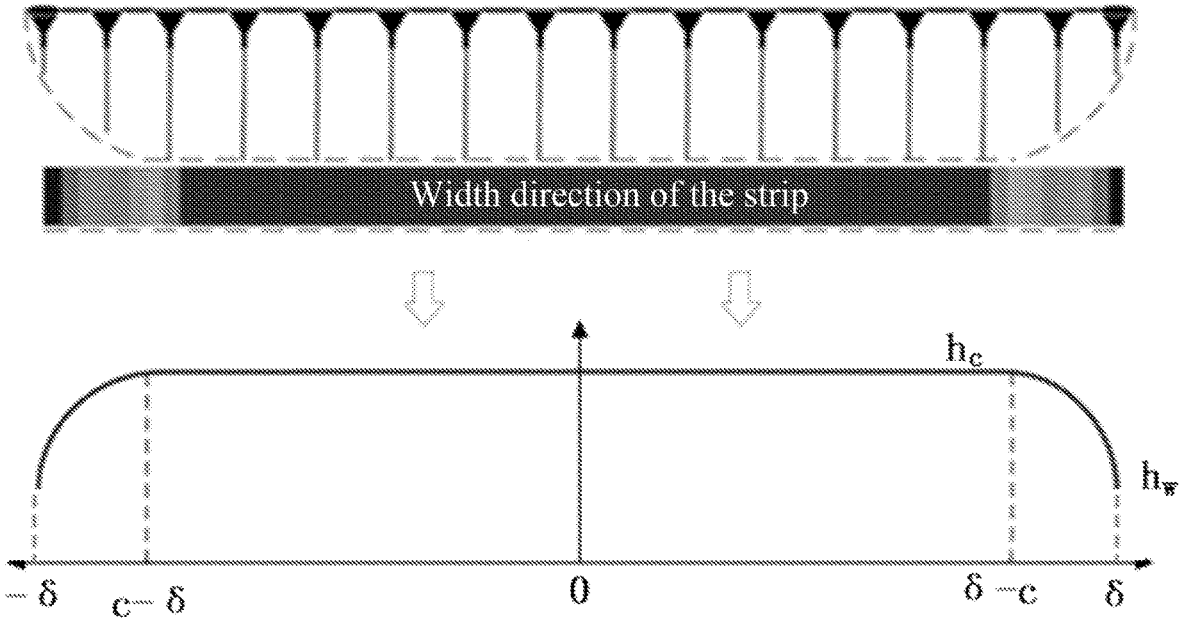
FIG. 7 shows a schematic diagram of heat transfer coefficients at different areas on an upper surface of the hot-rolled strip and heat transfer coefficient curves.

Step 4: third kind of boundary conditions are set for the finite element model established in step 3, including setting a heat transfer coefficient of a lower surface of the strip, and setting at least two parameters of a heat transfer coefficient h, in the middle area of the strip, a heat transfer coefficient $h_w$ at the edge of the strip, and a convexity ratio m, where the convexity ratio is $m=h_c/h_w$ as shown in FIG. 7.

In the present embodiment, the convexity ratio of the temperature field uniformly distributed in the width direction of the strip is m=1.3, the heat transfer coefficient of the lower surface of the strip is 400 $W/m^{2}\cdot{}^{\circ}C$., and the heat transfer coefficient in the middle area of the strip on the upper surface of the strip is $h_c$=450 $W/m^{2}\cdot{}^{\circ}C$.

Step 5: according to the geometric parameters and initial temperature parameters collected in step 2 and the third kind of boundary conditions set in step 3, an analytical solution T(x, t) of a transverse temperature field of the strip is obtained through a heat conduction partial differential equation.

Step 6: different types of middle convexity water cooling heat transfer coefficient curves are designed.

Figure 8:
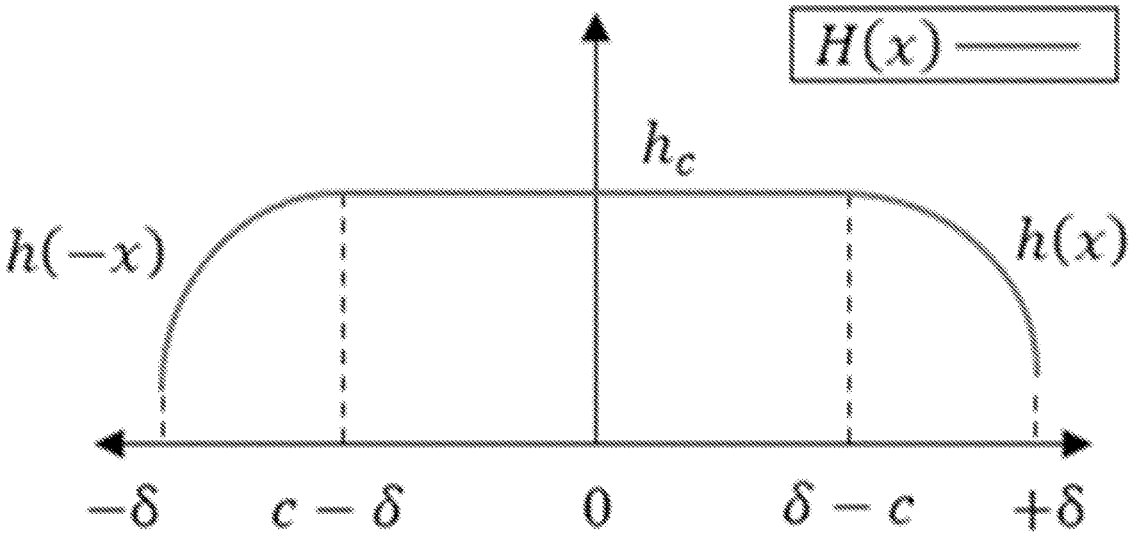
FIG. 8 shows a schematic diagram of a middle convexity water cooling heat transfer coefficient curve of the hot-rolled strip with approximate saddle shaped distribution.

In a water cooling process of laminar cooling of the hot-rolled strip, to achieve a transverse homogenizing cooling effect of the strip, according to an edge supercooling condition of the strip before the laminar cooling, different water cooling heat transfer coefficient curves are set for different transverse areas of the rolled strip, namely, the middle area and the edge temperature drop areas of the strip. The heat transfer coefficients in the middle area of the strip are basically the same, and the heat transfer coefficient in the edge area of the strip is lower as it gets closer to the edge, such that an overall transverse water cooling heat transfer coefficient curve of the strip presents approximate saddle shaped distribution, and is called the middle convexity water cooling heat transfer coefficient curve, expressed as H(x). If the water cooling heat transfer coefficient curve of the middle area of the strip is expressed as $h_c$, the water cooling heat transfer coefficient curve of the edge temperature drop area on one side of the strip is expressed as h(x), and the water cooling heat transfer coefficient curve of the edge temperature drop area on the other side of the strip is expressed as h(−x), as shown in FIG. 8, there is:

$$H(x)=\begin{cases} h(x), & x\in[\delta-c,\delta] \\ h_c, & x\in[c-\delta,\delta-c] \\ h(-x), & x\in[-\delta,c-\delta] \end{cases}. \tag{1}$$

The types of the water cooling heat transfer coefficient curve of the edge temperature drop area of the strip include but are not limited to primary functions, quadratic functions, sine cosine functions, logarithmic functions, and higher power functions. According to initial conditions of the strip, the water cooling heat transfer coefficient curve h(x) of the edge temperature drop area of the strip includes at least the following 6 types:

$$h_1(x)=\frac{(m-1)h_c}{mc}(-x+\delta)+\frac{h_c}{m}, \tag{2}$$

$$h_2(x)=\frac{(m-1)h_c}{mc^2}(-x+\delta)^2+\frac{h_c}{m}, \tag{3}$$

$$h_3(x)=\frac{(1-m)h_c}{mc^2}(-x+\delta)+\frac{2(m-1)h_c}{mc}(-x+\delta)+\frac{h_c}{m}, \tag{4}$$

-continued $$h_4(x)=\frac{(m-1)h_c}{mc^3}(-x+\delta)^3+\frac{h_c}{m}, \tag{5}$$

$$h_5(x)=\frac{(m-1)h_c}{m}\sin\left[\frac{\pi}{2c}(-x+\delta)\right]+\frac{h_c}{m}, \text{ and} \tag{6}$$

$$h_6(x)=\frac{(m-1)h_c}{mln(c+1)}\ln[(-x+\delta)+1]+\frac{h_c}{m}. \tag{7}$$

The middle convexity water cooling heat transfer coefficient curve H(x) includes at least the following 6 types:

$$H(x)=\begin{cases} h_i(x), & x\in[\delta-c,\delta],\ i\in[1,6] \\ h_c, & x\in[c-\delta,\delta-c] \\ h_i(-x), & x\in[-\delta,c-\delta],\ i\in[1,6] \end{cases}. \tag{8}$$

The water cooling heat transfer coefficient curve h(x) of the edge temperature drop area of the strip in the present embodiment includes at least the following 6 types:

$$h_1(x)=-1.04x+969, x\varepsilon[500,600], \tag{9}$$

$$h_2(x)=0.01(-x+600)^2+346, x\varepsilon[500,600], \tag{10}$$

$$h_3(x)=-0.01(-x+600)^2+2.0769(-x+600)+346, x\varepsilon[500,600], \tag{11}$$

$$h_4(x)=0.0001(-x+600)^3+346, x\varepsilon[500,600], \tag{12}$$

$$h_5(x)=103.85\sin[0.0157(-x+600)]+346, x\varepsilon[500,600], \text{ and} \tag{13}$$

$$h_6(x)=22.58\ln(-x+601)+346, x\varepsilon[500,600]. \tag{14}$$

Figure 9:
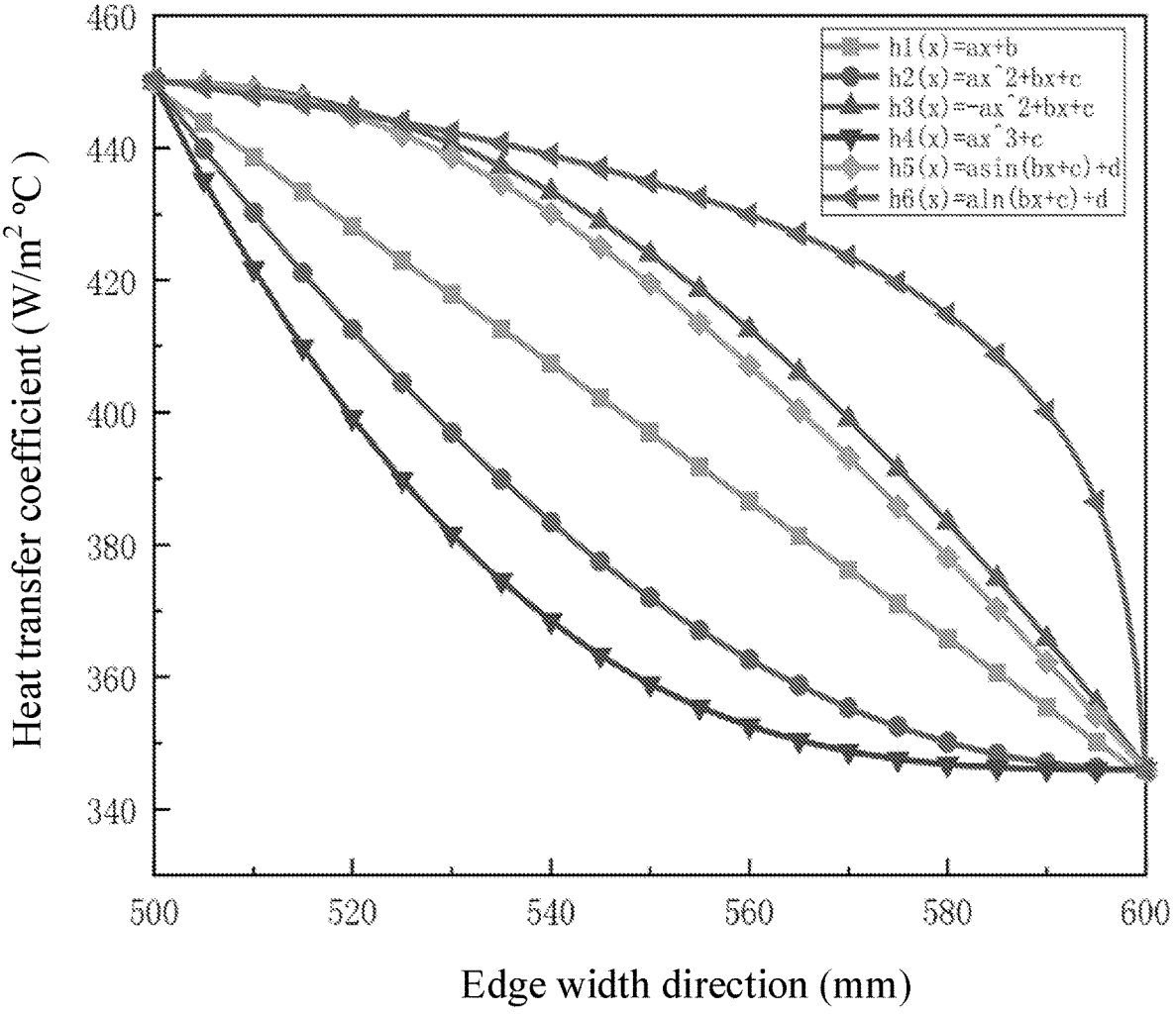
FIG. 9 shows a distribution diagram of different types of heat transfer curves at an edge temperature drop area of the strip according to an embodiment of the disclosure.

Thus, distribution of different water cooling heat transfer curves in the edge temperature drop area (xε[500,600] or xε[−600, −500]) of the strip is shown in FIG. 9. The middle convexity water cooling heat transfer coefficient curve within the range xε[−600,600] of the width direction of the strip H(x) is:

$$H(x)=\begin{cases} h_i(x), & x\in[500,600],\ i\in[1,6] \\ 450, & x\in[-500,500] \\ h_i(-x), & x\in[-600,-500],\ i\in[1,6] \end{cases}. \tag{15}$$

Step 7: Optimal transverse water flow density distribution of cooling water in a laminar cooling area corresponding to the different types of middle convexity water cooling heat transfer coefficient curves and middle convexity water volume distribution are calculated.

In the present disclosure, the analytical solution $T_s$=T(x, t) of the transverse temperature field of the strip and the different types of middle convexity water cooling heat transfer coefficient curves H(x) are substituted into a water volume calculation formula using MATLAB programming to obtain the transverse water flow density distribution of the cooling water in the laminar cooling area corresponding to each type of middle convexity water cooling heat transfer coefficient curve, and further obtain the approximate saddle shaped water volume distribution in the width direction of the hot-rolled strip corresponding to each type of middle convexity water cooling heat transfer coefficient curve, that is, the middle convexity water volume distribution.

The water volume calculation formula is:

$$h_w^* = \frac{9.72\times10^5 Q^{0.355}}{(T_s - T_w)}\left\{\frac{(2.5 - 1.5\ \log\ T_w)D}{P_L P_C}\right\}^{0.645}\times 1.163. \tag{16}$$

In the above formula, Q is a water flow density, $m^3/(min\ m\cdot^2)$. D is a nozzle diameter, m·$T_s$ is the temperature of upper and lower surfaces of the hot-rolled strip, ° C. $T_w$ is a temperature of cooling water, ° C. $P_L$ is a distance between a direction of the rolling line and the nozzle, m·$P_C$ is a distance between the vertical direction of the rolling line and the nozzle, m.

The transverse water flow density distribution of the cooling water in the laminar cooling area is:

$$Q(x, t) = \left\{\frac{9.72\times10^5}{H(x)[T(x, t) - T_w]}\left[\frac{(2.5 - 1.5\ \log\ T_w)D}{P_L P_C}\right]^{0.645}\times 1.163\right\}^{-2.8169}. \tag{17}$$

In the present embodiment, the nozzle diameter D=0.01 m, the temperature of cooling water is $T_2$=25° C., the distance between the direction of the rolling line and the nozzle is $P_L$=0.45 m, and the distance between the vertical direction of the rolling line and the nozzle is $P_C$=0.04 m. In the present embodiment, the middle convexity water cooling heat transfer coefficient curve within the range xε[−600,600] of the width direction of the strip H(x) is:

$$H(x) = \begin{cases} h_i(x), & x \in [500, 600],\ i \in [1, 6] \\ 450, & x \in [-500, 500] \\ h_i(-x), & x \in [-600, -500],\ i \in [1, 6] \end{cases}. \tag{18}$$

The analytical solution of one-dimensional unsteady wide direction temperature field during the laminar cooling is as follows:

$$T(x, t) = \sum_{n=1}^{\infty} \frac{2\mu_n \int_0^{\delta} \beta(x, 0)\ \cos\left(\mu_n \frac{x}{\delta}\right)dx}{\delta(\mu_n + \sin\ \mu_n\ \cos\ \mu_n)}\ \cos\left(\mu_n \frac{x}{\delta}\right)\ \exp\left(-\mu_n^2 \frac{at}{\delta^2}\right). \tag{19}$$

In the above formula, β is an excess temperature. t is the time. a is a thermal diffusivity of the material, where $a=\lambda/\rho c_p$, $c_p$ is a specific heat of the material, λ is a thermal conductivity, and ρ is a density of the material. $\mu_n$=kδ, where k is a scale coefficient.

In the actual laminar cooling process, the calculation of cooling time depends on the length L and speed v of the roller of the strip in the water cooling area, namely:

$$t = \frac{L}{v}. \tag{20}$$

In the present embodiment, the roller speed is about 10.25 m/s, and the length of the water cooling area is 110 m, so the analytical solution of the temperature field may be obtained as follows:

$$T_s = T(x,t) = 880\ \cos\ [0.003714(-x+600)-0.371456]\exp(-0.001465L) \tag{21}.$$

$T_s$ and H(x) are substituted into the water volume calculation formula using MATLAB programming to obtain the transverse water flow density distribution of the cooling water in the laminar cooling area of the present embodiment as follows:

$$Q(x, t) = \left\{\frac{9.72\times10^5}{H(x)[T(x, t) - T_w]}\left[\frac{(2.5 - 1.5\ \log\ T_w)D}{P_L P_C}\right]^{0.645}\times 1.163\right\}^{-2.8169}. \tag{22}$$

Transverse water flow density distribution of the cooling water in the laminar cooling area corresponding to each type of middle convexity water cooling heat transfer coefficient curve obtained in the present embodiment is shown in FIG. 10 to FIG. 15, and the middle convexity water volume distribution corresponding to each type of middle convexity water cooling heat transfer coefficient curve is further obtained.

Step 8: through calculation of the temperature field of the strip, an optimal type of middle convexity water cooling heat transfer coefficient curve is selected from the different types of middle convexity water cooling heat transfer coefficient curves, so as to determine optimal transverse water flow density distribution of the cooling water in the laminar cooling area, and further determine optimal middle convexity water volume distribution.

Step 8.1: based on the established finite element model, an actual temperature field of the rolled strip is calculated according to a current laminar cooling process, and temperature fields after laminar cooling corresponding to different types of middle convexity water cooling heat transfer coefficient curves is applied to an established finite element model are calculated.

Figure 16:
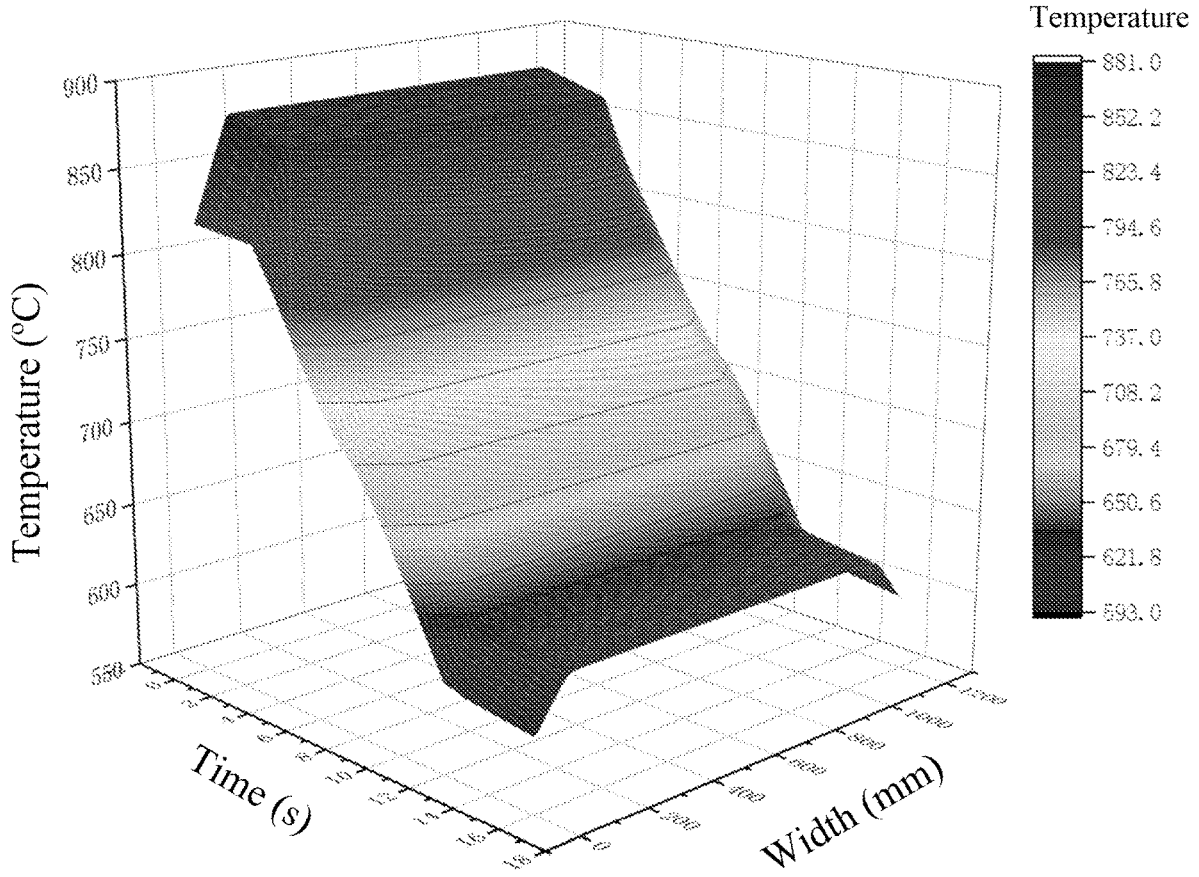
FIG. 16 shows a whole process evolution diagram of a transverse temperature of an actual temperature field of the Q235B hot-rolled strip after rolling calculated according to a current laminar cooling process according to an embodiment of the disclosure.
Figure 17:
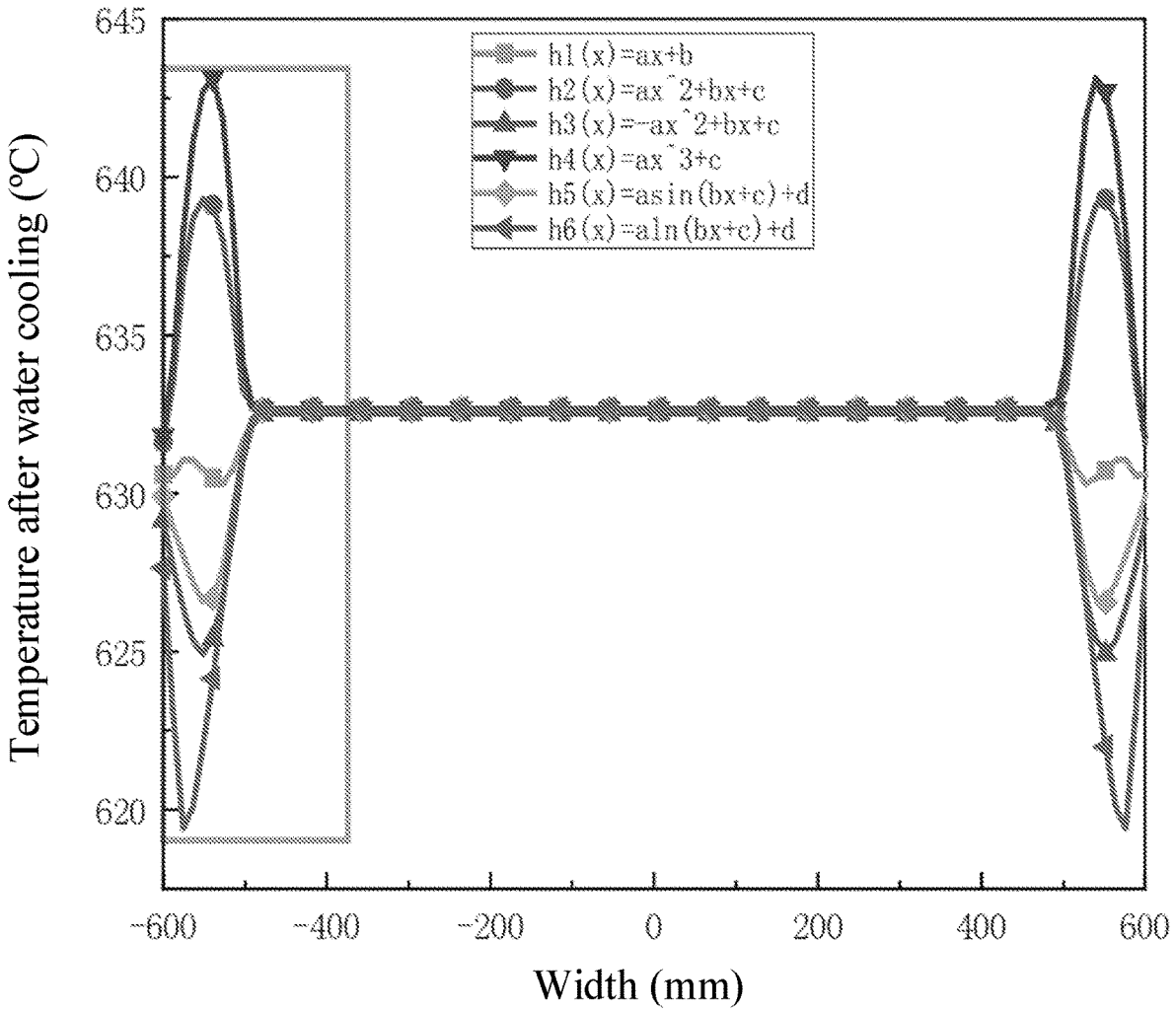
FIG. 17 shows a temperature field diagram after laminar cooling corresponding to different types of middle convexity water cooling heat transfer coefficient curves is applied to an established finite element model according to an embodiment of the disclosure.
Figure 18:
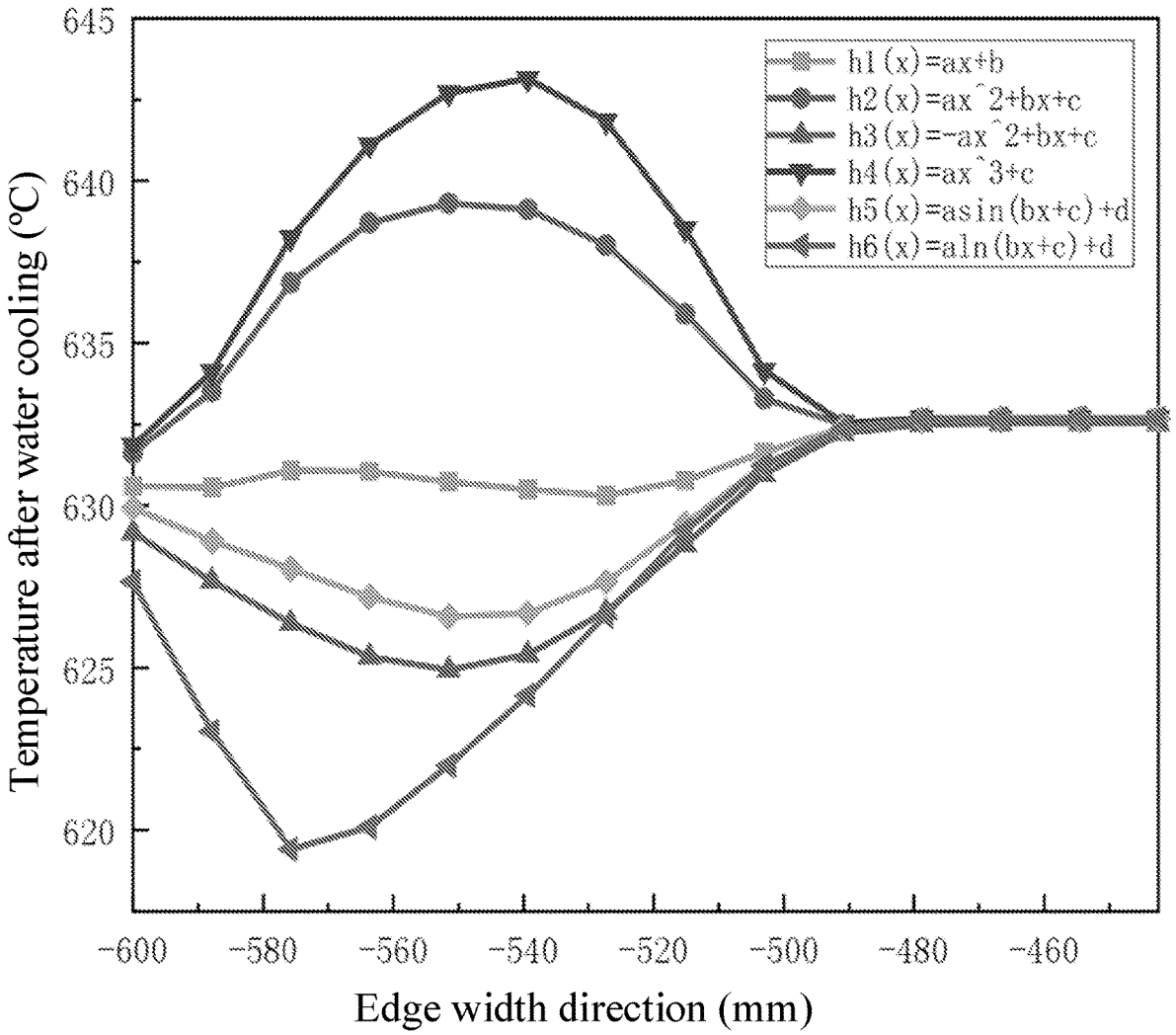
FIG. 18 shows an enlarged view of the edge temperature drop area on one side of FIG. 17.

The calculation of the actual temperature field of the rolled strip refers to the calculation based on the current actual uniform distribution of the cooling header without using the designed middle convexity water cooling heat transfer coefficient curve. The evolution of the actual temperature field of the rolled strip calculated according to the current laminar cooling process over time in the present embodiment is shown in FIG. 16. The final cooling effect of the actual temperature field of the rolled strip under the current laminar cooling process is shown in FIG. 16 as the transverse temperature distribution at the last moment (i.e., when the y-axis time t=16 s). The temperature fields after laminar cooling corresponding to different types of middle convexity water cooling heat transfer coefficient curves is applied to the established finite element model are shown in FIG. 17. The edge temperature drop area on one side of the strip in FIG. 17 is taken as an example to zoom in to get FIG. 18. The visual comparison results of the transverse temperature of the edge temperature drop area of the strip may be obtained through FIG. 18.

Step 8.2: The optimal type of middle convexity water cooling heat transfer coefficient curve is determined, so as to determine optimal transverse water flow density distribution of the cooling water in the laminar cooling area, and further determine optimal middle convexity water volume distribution.

The obtained actual temperature field of the rolled strip is compared with the temperature fields corresponding to the different types of middle convexity water cooling heat transfer coefficient curves, from which a temperature difference between the middle area and the edge temperature drop area of the strip after laminar cooling is analyzed, and the optimal middle convexity water cooling heat transfer coefficient curve is selected. The concavity of the optimal middle convexity water cooling heat transfer coefficient curve should be consistent with that of the temperature distribution curve of the edge temperature drop area of the strip, and the curvature change should be approximate.

In the present embodiment, the homogenizing cooling effects corresponding to different types of middle convexity water cooling heat transfer coefficient curves are shown in Table 1, where the peak value represents the highest temperature in the edge temperature drop area of the strip, and the valley value represents the lowest temperature in the edge temperature drop area of the strip.

TABLE 1

Comparison of homogenizing cooling effects corresponding to different types of middle convexity water cooling heat transfer coefficient curves

| Curve type | Peak value in edge temperature drop area (° C.) | Distance from peak value to edge (mm) | Valley value in edge temperature drop area (° C.) | Distance from valley value to edge (mm) | Temperature of middle area (° C.) | Temperature difference (° C.) |
|---|---|---|---|---|---|---|
| $h_1(x)$ | 631.07 | 24.2 | 630.3 | 72.7 | 632.68 | 0-2.7 |
| $h_2(x)$ | 639.3 | 48.5 | None | None | 632.7 | 6.6 |
| $h_3(x)$ | None | None | 624.9 | 48.5 | 632.5 | 7.6 |
| $h_4(x)$ | 643.2 | 60.6 | None | None | 632.7 | 10.5 |
| $h_5(x)$ | None | None | 626.6 | 48.5 | 632.7 | 6.1 |
| $h_6(x)$ | None | None | 619.4 | 24.2 | 632.7 | 13.3 |

According to Table 1 and FIG. 16, it may be determined that the middle convexity water cooling heat transfer coefficient curve type suitable for transverse temperature homogenization cooling of the Q235B hot-rolled strip in the present embodiment is $h_1$ (x), namely:

$$H(x) = \begin{cases} h_1(x), & x \in [500, 600] \\ 450, & x \in [-500, 500] \\ h_1(-x), & x \in [-600, -500] \end{cases} . \tag{23}$$

Figure 10:
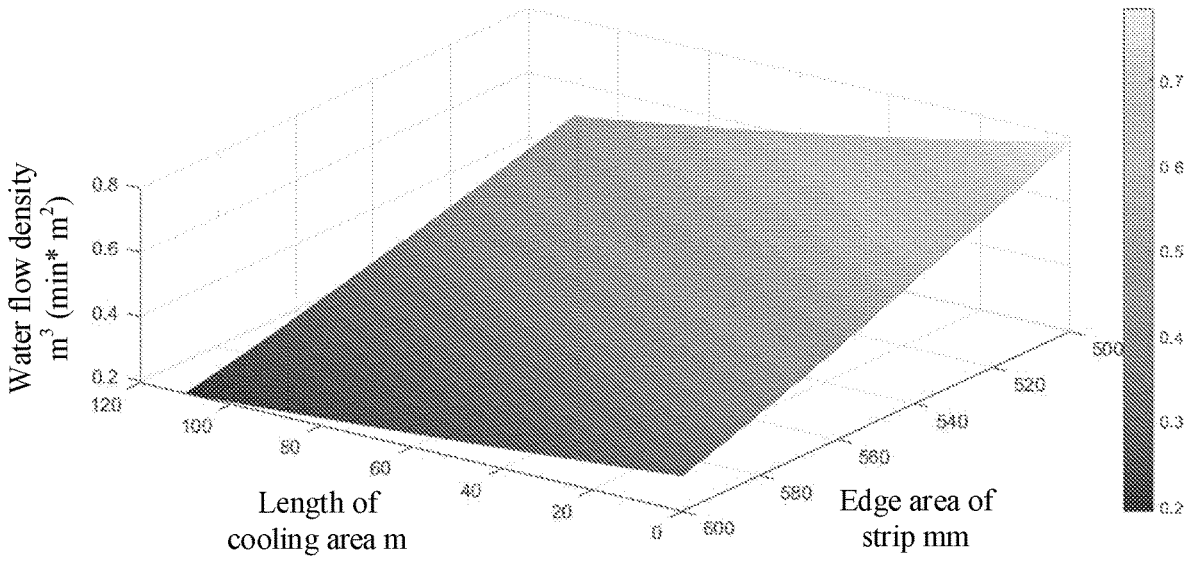
FIG. 10 shows a diagram of middle convexity water volume distribution corresponding to a water cooling heat transfer coefficient curve $h_1$ (x) at an edge temperature drop area of the Q235B hot-rolled strip according to an embodiment of the disclosure.
Figure 11:
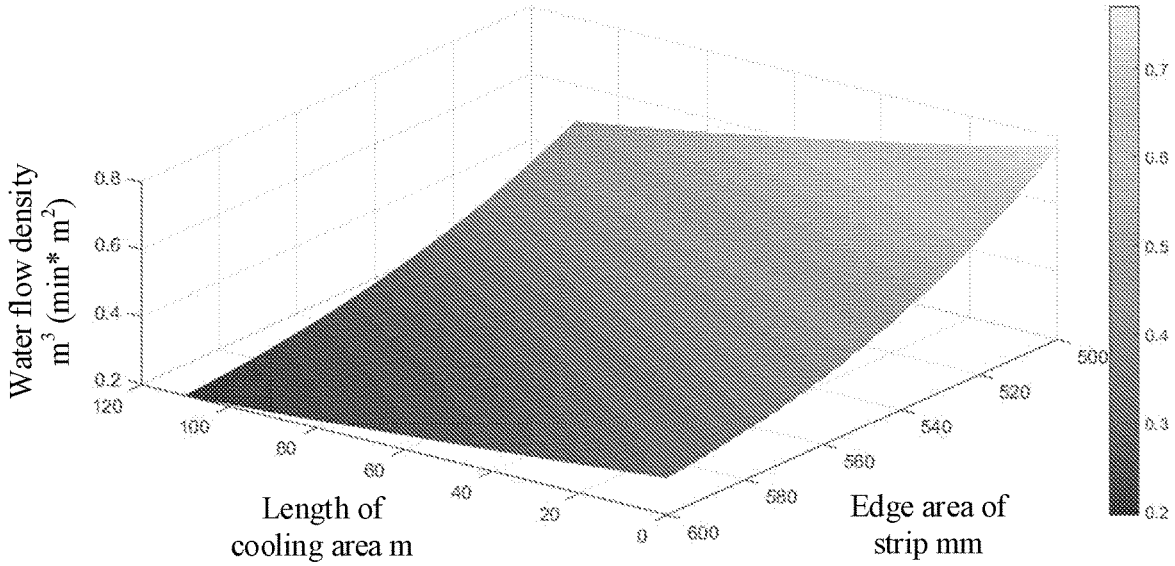
FIG. 11 shows a diagram of middle convexity water volume distribution corresponding to a water cooling heat transfer coefficient curve $h_2$ (x) at an edge temperature drop area of the Q235B hot-rolled strip according to an embodiment of the disclosure.
Figure 12:
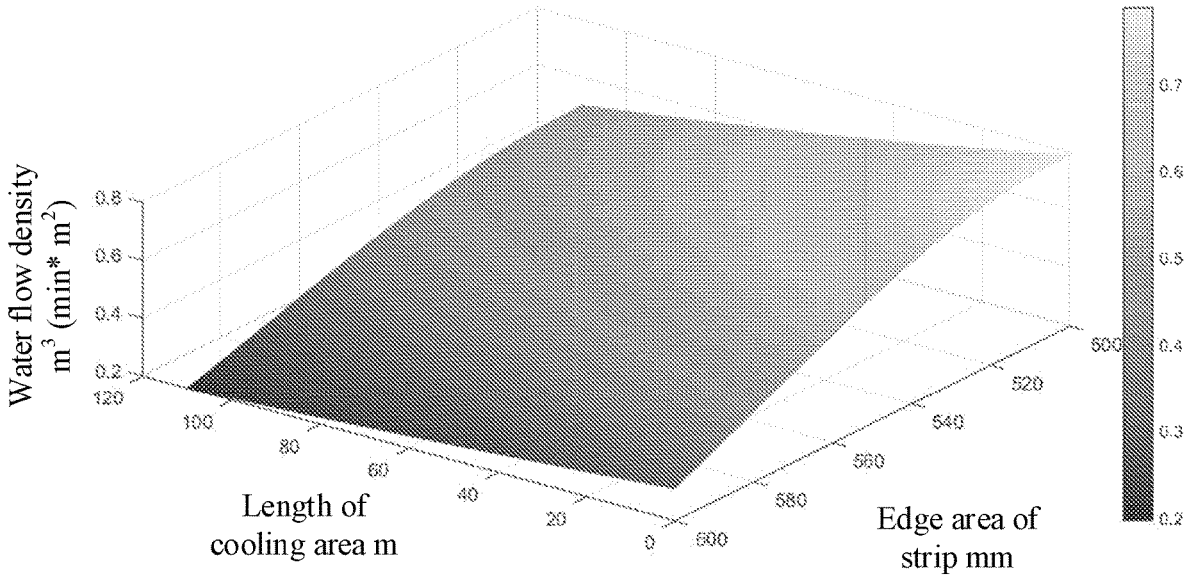
FIG. 12 shows a diagram of middle convexity water volume distribution corresponding to a water cooling heat transfer coefficient curve $h_3$ (x) at an edge temperature drop area of the Q235B hot-rolled strip according to an embodiment of the disclosure.
Figure 13:
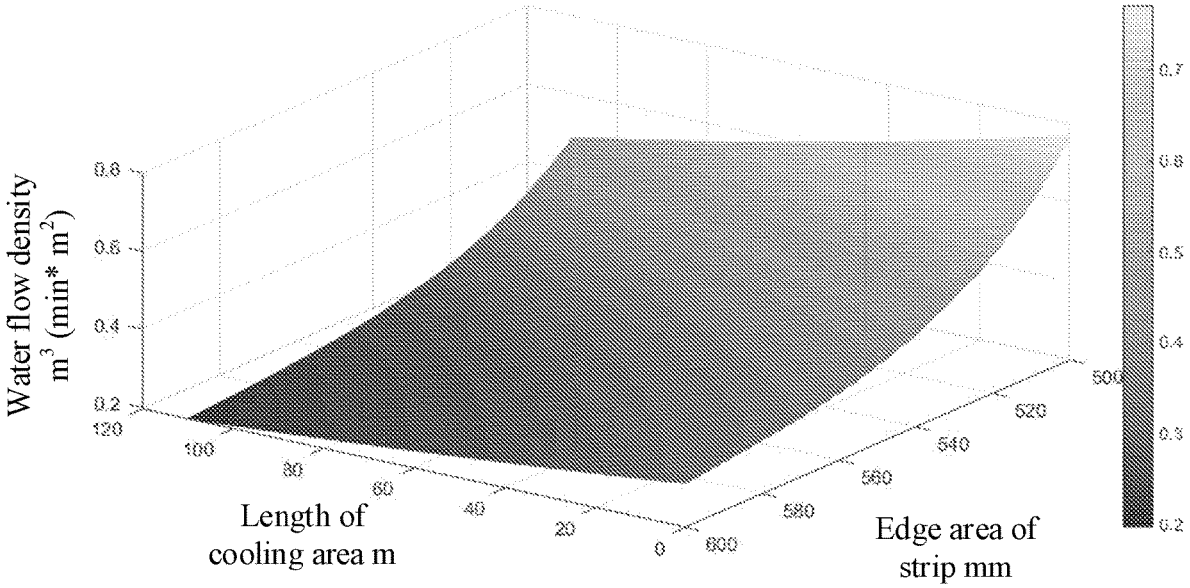
FIG. 13 shows a diagram of middle convexity water volume distribution corresponding to a water cooling heat transfer coefficient curve $h_4$ (x) at an edge temperature drop area of the Q235B hot-rolled strip according to an embodiment of the disclosure.
Figure 14:
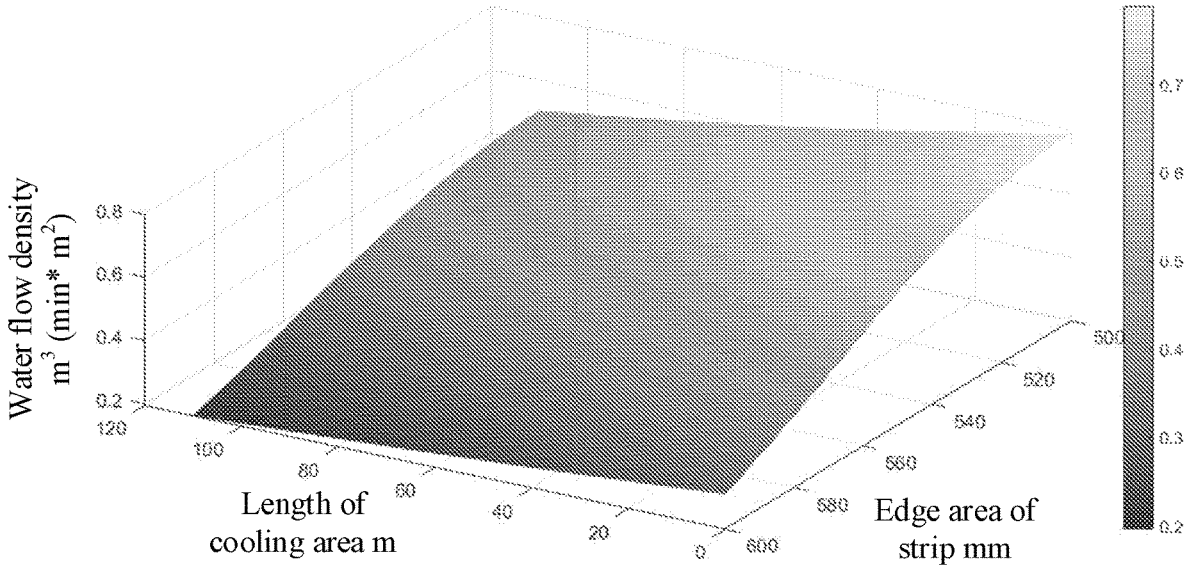
FIG. 14 shows a diagram of middle convexity water volume distribution corresponding to a water cooling heat transfer coefficient curve $h_5$ (x) at an edge temperature drop area of the Q235B hot-rolled strip according to an embodiment of the disclosure.
Figure 15:
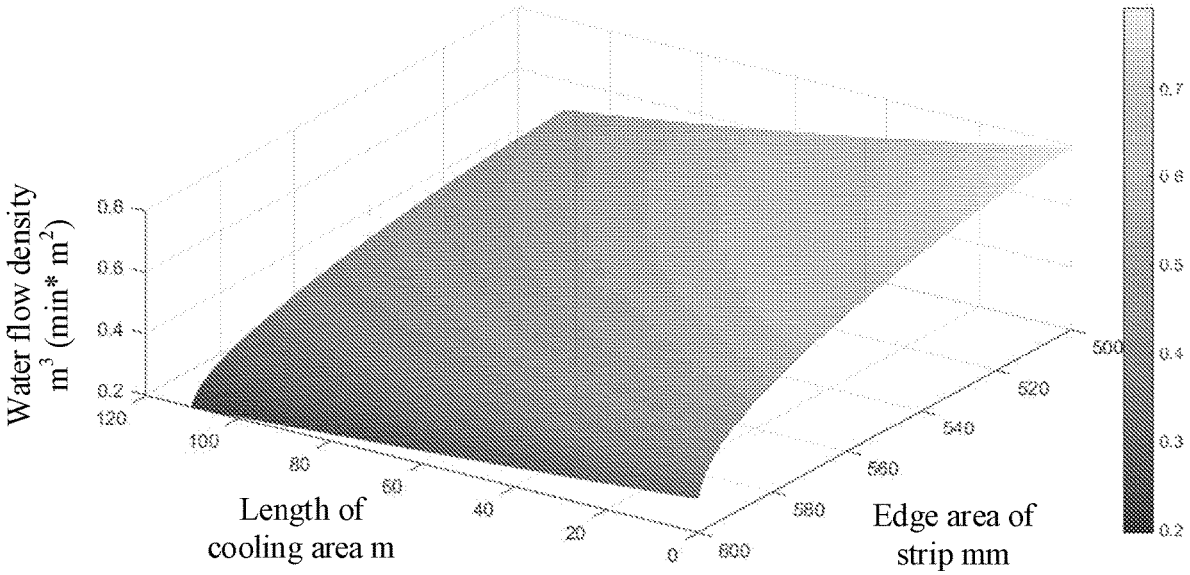
FIG. 15 shows a diagram of middle convexity water volume distribution corresponding to a water cooling heat transfer coefficient curve $h_6$ (x) at an edge temperature drop area of the Q235B hot-rolled strip according to an embodiment of the disclosure.

Thus, the transverse water flow density distribution of the cooling water in the laminar cooling area shown in FIG. 10 corresponding to the middle convexity water cooling heat transfer coefficient curve $h_1$ (x) is the optimal water flow density distribution, and the optimal middle convexity water volume distribution may be determined.

Finally, it should be noted that the above embodiments are merely illustrative of, rather than limiting of, the technical solution of the present disclosure. While the present disclosure is described in detail with reference to the foregoing embodiments, those of ordinary skill in the art should understand that modifications may still be made to the technical solutions described in the foregoing embodiments or equivalent replacements may be made to some or all technical features thereof. However, these modifications or replacements do not cause the essence of the corresponding technical solutions to depart from the scope defined by the claims of the present disclosure.

Various embodiments of the disclosure may have one or more of the following effects. In some embodiments, the disclosure may provide homogenization control methods for a transverse temperature during laminar cooling of hot-rolled strip. In these embodiments, a mathematical model of middle convexity cooling in a water volume may be established by designing different types of middle convexity water cooling heat transfer coefficient curves. Process procedures (e.g., heat transfer coefficients of upper and lower surfaces of the strip, roller speed, roller length, etc.) and equipment parameters of the hot-rolled strip during the laminar cooling may be comprehensively considered so that the actual situation on site may be restored to the maximum extent. Through finite element calculation, an optimal middle convexity water cooling heat transfer coefficient curve may be obtained. A process parameter corresponding to middle convexity water volume distribution during the laminar cooling (a water flow density) may be further obtained to guide a water volume regulation process. A water volume on a surface of the strip may present excellent saddle shaped distribution to ensure that a cooling speed of middle and edge areas of the strip may basically keep the same. In addition, uniform transverse temperature cooling of the hot-rolled strip may be achieved, and as a result, flatness defects caused by non-uniform transverse temperature cooling may be solved.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The disclosure claimed is:

1. A method for homogeneously controlling a transverse temperature during laminar cooling of a hot-rolled strip, comprising following steps:

(I) dividing a transverse area of an upper surface of the strip, according to distribution of the transverse temperature of the strip, into a middle area, a left edge area, and a right edge area, the middle area having a uniform transverse temperature and the left edge area and the right edge being symmetrical, having a same width, and having transverse temperature drop in a width direction;

(II) determining model parameters by collecting geometric parameters and initial temperature parameters of the strip, wherein:

the geometric parameters comprise a strip thickness t, a strip width b, a strip length e, a width of an edge temperature drop area of the strip c, and a transverse center coordinate, a left edge coordinate, and a right edge coordinate of the strip, and the initial temperature parameters comprise a temperature $T_0$ of the middle area of the strip and a temperature $T_0'$ of an edge of the strip;

(III) establishing a finite element model, according to the geometric parameters collected in step (II), by:

establishing a geometric model of the strip, assigning material thermophysical parameters and the initial temperature parameters to the geometric model, and performing element discretization by grid division of the model;

(IV) setting third-type boundary conditions for the finite element model established in step (III), comprising:

setting a heat transfer coefficient of a lower surface of the strip, and setting at least two parameters selected from the group consisting of a heat transfer coefficient in the middle area of the strip $h_c$, a heat transfer coefficient at the edge of the strip $h_w$, and a convexity ratio m;

(V) obtaining an analytical solution T(x, t) of a transverse temperature field of the strip through a heat conduction partial differential equation according to the geometric parameters, the initial temperature parameters, and the third-type boundary conditions;

(VI) designing different types of middle convexity water cooling heat transfer coefficient curves H(x);

(VII) calculating a transverse water flow density distribution of the cooling water in a laminar cooling area corresponding to the different types of middle convexity water cooling heat transfer coefficient curves; and (VIII) selecting an optimal middle convexity water cooling heat transfer coefficient curve to determine optimal transverse water flow density distribution of the cooling water in the laminar cooling area and to determine optimal middle convexity water volume distribution.

2. The method according to claim 1, wherein:

a central axis in the width direction of the strip is taken as the center coordinate x=0; and the left edge coordinate and the right edge coordinate are $x=\pm b/2=\pm\delta$.

3. The method according to claim 2, wherein the middle convexity water cooling heat transfer coefficient curve H(x) is:

$$H(x)=\begin{cases} h(x), & x\in[\delta-c,\delta] \\ h_c, & x\in[c-\delta,\delta-c] \\ h(-x), & x\in[-\delta,c-\delta] \end{cases}, \tag{1}$$

wherein:

$h_c$ is the water cooling heat transfer coefficient curve of the middle area of the strip, h(x) is the water cooling heat transfer coefficient curve of the edge temperature drop area on one side of the strip, and h(−x) is the water cooling heat transfer coefficient curve of the edge temperature drop area on another side of the strip.

4. The method according to claim 3, wherein the water cooling heat transfer coefficient curve of the edge temperature drop area of the strip comprises at least one item selected from the group consisting of primary functions, quadratic functions, sine cosine functions, logarithmic functions, and higher power functions.

5. The method according to claim 4, wherein the water cooling heat transfer coefficient curve h(x) of the edge temperature drop area of the strip comprises at least one item selected from the group consisting of:

$$h_1(x)=\frac{(m-1)h_c}{mc}(-x+\delta)+\frac{h_c}{m}, \tag{2}$$

$$h_2(x)=\frac{(m-1)h_c}{mc^2}(-x+\delta)^2+\frac{h_c}{m}, \tag{3}$$

-continued $$h_3(x)=\frac{(1-m)h_c}{mc^2}(-x+\delta)+\frac{2(m-1)h_c}{mc}(-x+\delta)+\frac{h_c}{m}, \tag{4}$$

$$h_4(x)=\frac{(m-1)h_c}{mc^3}(-x+\delta)^3+\frac{h_c}{m}, \tag{5}$$

$$h_5(x)=\frac{(m-1)h_c}{m}\sin\left[\frac{\pi}{2c}(-x+\delta)\right]+\frac{h_c}{m}, \text{ and} \tag{6}$$

$$h_6(x)=\frac{(m-1)h_c}{mln(c+1)}\ln[(-x+\delta)+1]+\frac{h_c}{m}. \tag{7}$$

6. The method according to claim 5, wherein the middle convexity water cooling heat transfer coefficient curve H(x) is:

$$H(x)=\begin{cases} h_i(x), & x\in[\delta-c,\delta],\ i\in[1,6] \\ h_c, & x\in[c-\delta,\delta-c] \\ h_i(-x), & x\in[-\delta,c-\delta],\ i\in[1,6] \end{cases}. \tag{8}$$

7. The method according to claim 5, wherein a method for calculating the middle convexity water volume distribution corresponding to the different types of middle convexity water cooling heat transfer coefficient curves comprises substituting the analytical solution T(x, t) of the transverse temperature field of the strip and the different types of middle convexity water cooling heat transfer coefficient curves into a water volume calculation formula to obtain the transverse water flow density distribution of the cooling water in the laminar cooling area corresponding to each type of middle convexity water cooling heat transfer coefficient curve, and to further obtain approximate saddle shaped water volume distribution in the width direction of the strip corresponding to each type of middle convexity water cooling heat transfer coefficient curve.

8. The method according to claim 5, wherein a method for selecting the optimal middle convexity water cooling heat transfer coefficient curve from the different types of middle convexity water cooling heat transfer coefficient curves comprises following steps:

calculating an actual temperature field of the strip according to a current laminar cooling process based on the established finite element model;

calculating temperature fields of the different types of middle convexity water cooling heat transfer coefficient curves for the established finite element model;

comparing the actual temperature field of the strip with the temperature fields of the different types of middle convexity water cooling heat transfer coefficient curves;

analyzing a temperature difference between the middle area and the edge temperature drop area of the strip after laminar cooling for each temperature field; and selecting a middle convexity water cooling heat transfer coefficient curve corresponding to a minimum temperature difference as an optimal middle convexity water cooling heat transfer coefficient curve.

9. The method according to claim 1, wherein a method for calculating the middle convexity water volume distribution corresponding to the different types of middle convexity water cooling heat transfer coefficient curves comprises substituting the analytical solution T(x, t) of the transverse temperature field of the strip and the different types of middle convexity water cooling heat transfer coefficient curves into a water volume calculation formula to obtain the transverse water flow density distribution of the cooling water in the laminar cooling area corresponding to each type of middle convexity water cooling heat transfer coefficient curve, and to further obtain approximate saddle shaped water volume distribution in the width direction of the strip corresponding to each type of middle convexity water cooling heat transfer coefficient curve.

10. The method according to claim 1, wherein a method for selecting the optimal middle convexity water cooling heat transfer coefficient curve from the different types of middle convexity water cooling heat transfer coefficient curves comprises following steps:

calculating an actual temperature field of the strip according to a current laminar cooling process based on the established finite element model;

calculating temperature fields of the different types of middle convexity water cooling heat transfer coefficient curves for the established finite element model;

comparing the actual temperature field of the strip with the temperature fields of the different types of middle convexity water cooling heat transfer coefficient curves;

analyzing a temperature difference between the middle area and the edge temperature drop area of the strip after laminar cooling for each temperature field; and selecting a middle convexity water cooling heat transfer coefficient curve corresponding to a minimum temperature difference as an optimal middle convexity water cooling heat transfer coefficient curve.

* * * * *